United States Patent [19]

Iwase et al.

[11] 3,979,014

[45] Sept. 7, 1976

[54] SEAL DEVICE FOR USE IN FLANGE MATING SURFACES OF VACUUM CONTAINER

[75] Inventors: Hiroo Iwase, Juocho; Satoshi Ninomiya, Hitachi, both of Japan

[73] Assignee: Hitachi, Ltd., Japan

[22] Filed: Nov. 26, 1974

[21] Appl. No.: 527,230

[52] U.S. Cl. ..... 220/240

[51] Int. Cl.[2] ..... B65D 53/00

[58] Field of Search ..... 220/240, 277

[56] References Cited

UNITED STATES PATENTS

| | | | |
|---|---|---|---|
| 2,203,364 | 6/1940 | Rathbun | 220/240 |
| 3,127,050 | 3/1964 | McDaniels | 220/277 |
| 3,225,956 | 12/1965 | Laming | 220/240 |
| 3,430,801 | 3/1969 | Hohrig | 220/240 |

FOREIGN PATENTS OR APPLICATIONS

| | | | |
|---|---|---|---|
| 1,965,850 | 7/1971 | Germany | 220/240 |
| 602,724 | 3/1960 | Italy | 220/240 |
| 937,588 | 9/1963 | United Kingdom | 220/240 |

*Primary Examiner*—Ro E. Hart
*Attorney, Agent, or Firm*—Craig & Antonelli

[57] ABSTRACT

A seal device for use in the flange mating surfaces of a vacuum container of the type, in which there are provided a first member and a second member, both of which are formed with flanges, respectively, and in which the aforesaid flanges are bolted together so as to maintain the interior of the container to a lower pressure, as compared with the atmospheric pressure. With this type container, the aforesaid bolts are located outwardly on the flange mating surfaces, and a first space is provided on the innermost side of the flange mating surfaces but inwardly of the aforesaid bolts, while a second space is provided thereon between the bolts and the first space. The first space is communicated with steam guide holes provided in either of the aforesaid flanges, while steam guide holes are in communication with a steam generating source so that steam having a pressure higher than the atmospheric pressure outside the container is introduced into the first space. On the other hand, the second space is in communication with steam discharge holes provided in either of the flanges, while the aforesaid steam discharge holes are in communication with a pressure maintaining means adapted to maintain the second space to a pressure lower than the atmospheric pressure outside the container.

10 Claims, 10 Drawing Figures

SEAL DEVICE FOR USE IN FLANGE MATING SURFACES OF VACUUM CONTAINER

BACKGROUND OF THE INVENTION

1. Field of the Invention

This invention relates to a seal device or an air sealing device for use in the flange mating surfaces of a vacuum container, particularly, a low pressure exhaust chamber of a steam turbine for use in a boiling water type nuclear reactor.

2. Description of the Prior Art

Hitherto, a low pressure exhaust chamber of a steam turbine for use in a boiling water type nuclear reactor is split into segments due to the limitations arising from the viewpoints of machining, transportion, assembly and disassembly, so that there have to be used many flanges which are to be jointed on their mating surfaces. However, complete sealing may not be achieved for flange mating surfaces which overlap each other to a cross pattern. this necessitates the use of a special device such as an air extractor and a vacuum pump for extracting air from the low pressure exhaust chamber.

However, in a boiling water type, nuclear reactor power plant, steam produced in the nuclear reactor possibly contains a very small amount of radioactive non-condensive vapor, as the case may be, so that such steam may be possibly mixed with air flowing into the container, thus presenting a source of a great amount of polluted vapor. The production of such polluted vapor then dictates the use of an excessive or unwanted device for treating the vapor thus polluted.

Recently, a rare gas hold-up apparatus has been adopted for treating polluted vapor. However, this type apparatus is massive, while the capacity thereof is governed by the amount of air to be taken in the low pressure exhaust chamber. Accordingly, for rendering smaller the size of this massive apparatus, it is imperative to reduce the amount of air being taken in the low pressure exhaust chamber.

SUMMARY OF THE INVENTION

The present invention is directed to avoiding the aforesaid short-comings.

It is accordingly an object of the present invention to provide a seal device for use in the flange mating surfaces of a container which has flanges to be jointed by means of fastening members, for preventing the high pressure fluid from leaking through the mating surfaces of the aforesaid flanges to the side of a low pressure fluid.

It is another object of the present invention to provide a seal device for use in the flange mating surfaces of a vacuum container, or a low pressure exhaust chamber which prevents the inflowing of air therein and which may render smaller the size of a polluted-air treating apparatus.

It is a further object of the present invention to provide a seal device for use in the mating surfaces of conventional flanges, without increasing the size thereof but achieving the aforesaid two objects.

It is a yet further object of the present invention to provide a seal device for use in the mating surfaces of flanges, which seal device may maintain sealing fluid to a given purity.

According to the present invention, there is provided a seal device for use in the mating surfaces of flanges of a container of the type, which is provided with first and second members each having flanges which are to be jointed by means of fastening members, said sealing device being characterized in that there are provided a first space and a second space in the mating surface of a flange, the aforesaid first space being located inwardly of the fastening members in the mating surface of one of the flanges and communicated with a sealing fluid guide hole provided in either of the aforesaid flanges, the sealing fluid guide hole being in communication with a sealing fluid generating source, the second space being in communication with sealing fluid discharge holes provided in either the flanges, and the sealing fluid discharge holes being in communication with means for maintaining the second space to a given pressure.

DESCRIPTION OF THE PREFERRED EMBODIMENTS

Now, description will be given of one embodiment of the present invention in conjunction with the accompanying drawings.

Figure 1:
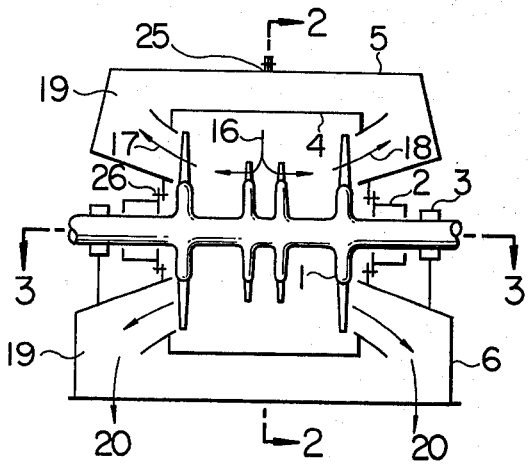
FIG. 1 is a view showing the outline of a steam turbine provided with an air seal device according to the present invention.
Figure 2:
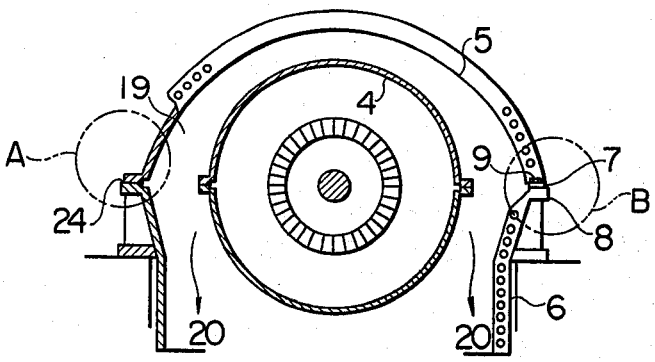
FIG. 2 is a cross-sectional view taken along the line 2—2 of FIG. 1.

In general, with a nuclear steam turbine which is used in combination with a boiling water type nuclear reactor, steam which has been generated in the nuclear reactor is directly fed to the turbine, together with a very small amount of radioactive non-condensive vapor. This steam is then fed into a high pressure turbine for working and expanded to give a relatively low pressure and low temperature, after which the steam is introduced into a central portion 16 of a low pressure turbine as shown in FIG. 1.

The steam which has been admitted into the low pressure turbine is then fed from the central portion 16 to the right and left sides as shown by arrows 17, 18 to thereby rotate a rotor 1 supported by means of bearings 3 which are located on the opposite sides of a low pressure lower half external wheel chamber 6, and then fed into an exhaust chamber 19 defined between a low pressure internal wheel chamber 4 and low pressure, upper-and-lower half outer wheel chambers 5, 6, eventually flowing in the direction shown by an arrow 20 into a condensor (not shown) for condensation.

The aforesaid exhaust chamber 19 dictates to be maintained to a high vacuum level below the atmospheric pressure for improving the thermal effeciency, so requiring a sealing means against atmosphere. This is particularly true with three flange-mating portions which are split for accommodating assembly and disassembly, i.e., (i) a flange mating portion 24 between low pressure, upper-and-low half outer wheel chambers 5, 6, (ii) a vertical flange mating portion 25 in the low pressure, upper-half wheel chamber 5 and (iii) a flange mating portion 26 between the low pressure, upper-and-lower half outer wheel chambers 5, 6 and a packing case 2. On the other hand, the seal between the rotor 1 and the exhaust chamber 19 has been proved to be of a high reliability due to the functions and operations in service. This is due to labyrinth packings fitted in the packing case 2.

Figure 3:
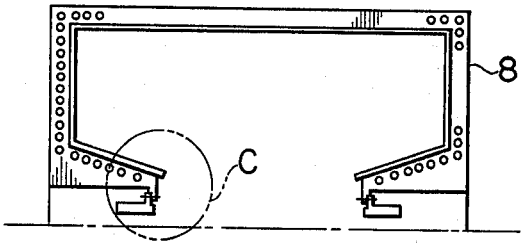
FIG. 3 is a cross-sectional view taken along the line 3—3 of FIG. 1.

Referring now to the flange mating portion 24 of the low pressure upper-and-lower half outer wheel chambers 5, 6, of the aforesaid three mating portions. An upper half flange 7 is fastened by means of tightening bolts 8 to a lower half flange 8, while the mating surfaces of the flanges in the mating portion 24 covers a considerably large area as shown in FIG. 3, thus presenting difficulties in sealing the flange mating surfaces completely. In addition, further difficulties are confronted by the portion where the vertical flanges of the aforesaid vertical flange portions 25, 26 intersect with the aforesaid mating portion 24, presenting a possibility of air being introduced into the exhaust chamber 19 to some extent.

Figure 4:
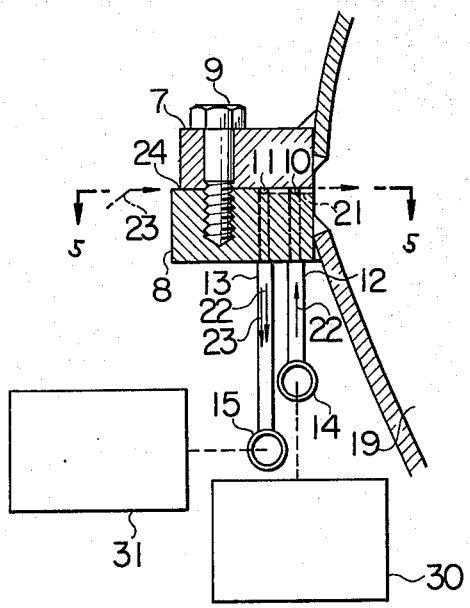
FIG. 4 is an enlarged view of the portion of A of FIG. 2.
Figure 5:
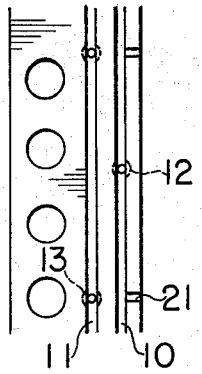
FIG. 5 is a cross-sectional view taken along the line 5—5 of FIG. 4.
Figure 6:
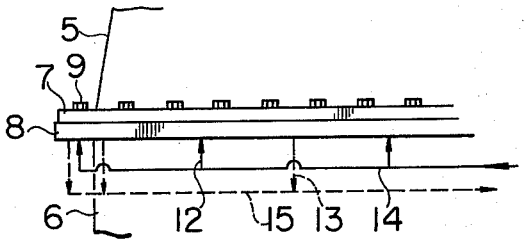
FIG. 6 is a view showing the diagram of a piping system.

As means for preventing the inflow of air into the exhaust chamber 19, there is provided an arrangement as shown in FIGS. 4 to 6, in which there are provided in parallel a supply groove 10 and a discharge groove 11 in the mating surface of either of the lower flange 8 and the upper half flange 7 but in a manner that the supply groove is located inwardly (to the side of exhaust chamber 19), while the discharge groove is located outwardly (to the side of atmosphere), and in which a given number of supply pipes 12 and discharge pipes 13 are connected to the respective grooves 10 and 11, the supply pipes 12 and discharge pipes 13 connecting by way of a supply main pipe 14 and a discharge main pipe 15 with a sealing-fluid generating device 30 and a pressure maintaining device 31, respectively, the supply groove 10 being in communication with the exhaust chamber 19 via a given number of relief grooves 21.

The aforesaid discharge groove 11 is maintained to a pressure lightly lower than the atmospheric pressure by way of the discharge pipes 13 and a discharge main pipe 15. On the other hand, fed to the supply grooves 10 through supply main pipe 14 and supply pipes 12 as sealing fluid is steam or water 22 which has a pressure slightly higher than atmospheric pressure and is not polluted due to radioactive material, while steam or water 22 is normally discharged through relief grooves 21 into the exhaust chamber 19. The supply source of steam or water and the setting of the pressure thereof may readily be achieved by utilizing the functions of turbine equipments.

If, for some reason or another, there is a gap in the flange mating portion 24, then the steam or water 22 being supplied to the supply groove 10 overflows the groove 10, so that part of steam or water flows into the exhaust chamber 19 and part of the steam or water flows into the discharge groove 11. For this reason, the air in the atmosphere which has made ingress through the aforesaid gap and has been collected in the discharge groove 11, together with steam or water 22, is discharge via discharge pipes 13 and discharge main pipe 15, rather than into the exhaust chamber 19, so that the amount of the noncondensive vapor is not increased. This accordingly may eliminates a need to increase the capacity of a polluted-air treating apparatus.

In this manner, the air which has been collected in the discharge groove 11 is mixed with pure steam or water, so that the air may be discharged into atmosphere without applying any treatment thereto.

Figure 9:
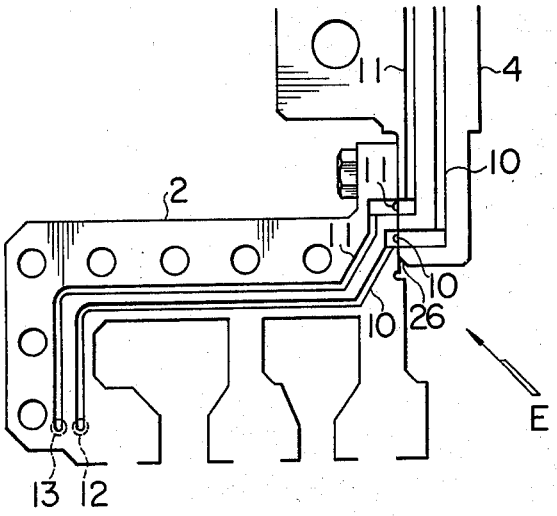
FIG. 9 is an enlarged view of the portion C of FIG. 3.
Figure 7:
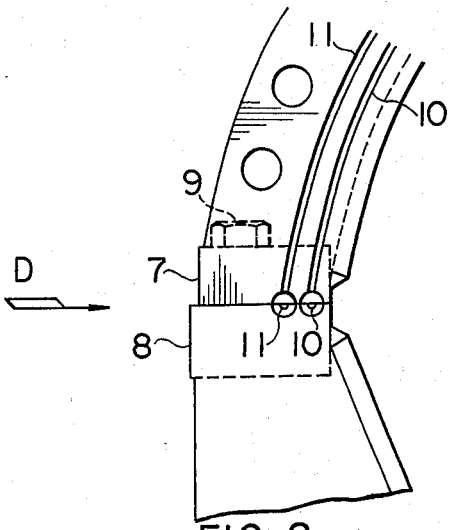
FIG. 7 is a enlarged view of the portion B of FIG. 2.
Figure 8:
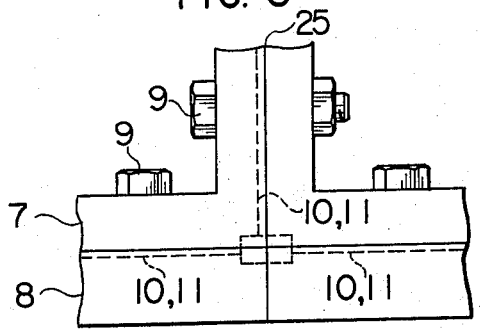
FIG. 8 is a view as viewed in the direction of an arrow D.
Figure 10:
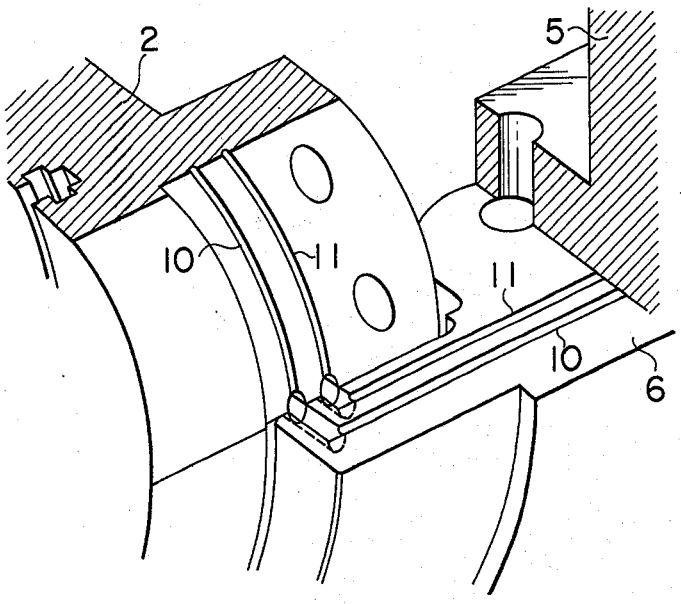
FIG. 10 is a view as viewed in the direction of an arrow E.

The sealing condition of the vertical flange mating portion 25 of the low pressure, upper-half outer wheel chamber 5 is as shown in FIGS. 7 and 8, while the sealing condition of the vertical flange mating portion 26 between the low pressure, upper-and-lower half outer wheel chambers 5, 6, and the packing case 2 is as shown in FIGS. 9 and 10. In this respect, the constructions and functions of the flange mating portions 25, 26 are identical to those of the aforesaid flange mating portion 24. Thus, duplicated description is omitted of the flange mating portions 25, 26.

As is apparent from the foregoing description, according to the present invention, in case air in atmosphere flows through the flange mating portion inwards, the air is collected in the discharge groove of a low pressure, and then discharged together with pure steam and water which is being supplied under a high pressure into the supply groove, thereby preventing an increase in amount of such polluted vapor which requires treatment and hence its ingress into the container should be prevented. This may render the size of the polluted air treating apparatus smaller.

What is claimed is:

1. In a seal device for use in the flange mating surfaces of a container of the type, in which there are provided a first member and a second member both having flanges which are fastened together by means of fastening members; the improvements comprising:

a first space and a second space defined in said flange mating surfaces of said first and second members;

sealing fluid guide holes defined in either of said flanges;

sealing fluid discharge holes defined in either of said flanges;

a sealing fluid generating source; and means for maintaining said second space to a given pressure;

said first space being located inwardly of said fastening members in said mating surfaces of said flanges and communicated with said sealing fluid guide holes which are communicated with said sealing fluid generating source; and said second space being communicated with said sealing fluid discharge holes which are communicated with said means for maintaining said second space to a given pressure.

2. A seal device for use in the flange mating surfaces of a container as set forth in claim 1, wherein said first and second spaces are of a channel or groove form and extending along the outer peripheries of said flange mating surfaces therein.

3. A seal device for use in the flange mating surfaces of a container as set forth in claim 1, wherein said first and second spaces are formed by mating an upper flange with an lower flange, said first and second spaces being defined in the flange mating surface of said lower flange.

4. A seal device for use in the flange mating surfaces of a container as set forth in claim 3, wherein said guide holes and said discharge holes are defined in said lower flange.

5. A seal device for use in the flange mating surfaces of a container as set forth in claim 3, wherein said guide holes and discharge holes are provided in a plural member and disposed in staggered relation.

6. A seal device for use in the flange mating surfaces of a container as set forth in claim 1, wherein said guide holes are in communication with the interior of said container through relief passages or grooves provided in either of said flanges.

7. A seal device for use in the flange mating surfaces of a container, as set forth in claim 1, wherein said fastening means are bolts.

8. In a seal device for use in the flange mating surfaces of a container of the type, in which there are provided a first member and a second member both having flanges which are fastened together by means of fastening members; the improvements comprising:

a first space and a second space defined in said flange mating surfaces of said first and second members;

sealing fluid guide holes defined in either of said flanges;

sealing fluid discharge holes defined in either of said flanges;

a sealing fluid generating source; and means for maintaining said second space to a given pressure;

said first space being located in the innermost position in said flange mating surface and communicated with said sealing fluid guide holes which are in communication with said sealing fluid generating source, said space being in communication with said sealing fluid discharge holes which are in communication with said means for maintaining said second space to a given pressure, said fastening members being located outwardly in said flange mating surface, and said second space being located between said first space and said fastening members.

9. A seal device for use in the flange mating surfaces of a container as set forth in claim 8, wherein said sealing fluid is steam and said guide holes are in communication with the interior of said container through relief passages or grooves provided in either of said flanges.

10. A seal device for use in the flange mating surfaces of a container as set forth in claim 9, wherein the interior of said container is maintained to a pressure lower than the atmosphere, the sealing fluid to be fed from said sealing fluid generating source into said first space is maintained to a pressure higher than the atmosphere outside said container, and said second space is in communication with said means for maintaining said second space to a pressure lower than the atmosphere outside said container.

* * * * *